US005524367A

United States Patent [19]

Ferreira et al.

[11] Patent Number: 5,524,367

[45] Date of Patent: *Jun. 11, 1996

[54] REMOVABLE SHOE SPIKE LOCKABLE TO CONFIGURED SOLE PLATE

[75] Inventors: Joseph J. Ferreira, Raynham, Mass.; Roy S. Collins, Sutton Coldfield, United Kingdom

[73] Assignee: Trisport, Ltd., England

[ * ] Notice: The term of this patent shall not extend beyond the expiration date of Pat. No.5, 123,184.

[21] Appl. No.: 865,287

[22] Filed: Apr. 8, 1992

Related U.S. Application Data

[63] Continuation of Ser. No. 124,145, Nov. 23, 1987, Pat. No. 5,123,184.

[51] Int. Cl.[6] ..... A43B 5/00

[52] U.S. Cl. ..... 36/134.000; 36/65

[58] Field of Search ..... 36/134, 127, 126, 36/67 R, 67 D, 128, 67 A, 65

[56] References Cited

U.S. PATENT DOCUMENTS

| | | | |
|---|---|---|---|
| 1,768,426 | 6/1930 | Stelzer | 36/67 D |
| 2,223,794 | 12/1940 | Pierce et al. | 36/67 D |
| 2,276,887 | 3/1942 | Smith | 36/67 D |
| 2,292,299 | 8/1942 | Smith | 36/67 D |
| 2,689,417 | 9/1954 | Bernstein | 36/67 D |
| 2,774,151 | 12/1956 | Dahlquist et al. | 36/670 |
| 2,784,503 | 3/1957 | Anderson | 36/127 |
| 3,328,901 | 7/1967 | Strickland | 36/127 |
| 3,597,863 | 8/1971 | Austin | 36/127 |
| 4,648,187 | 3/1987 | Dassler et al. | 36/134 |
| 5,123,184 | 6/1992 | Ferreira | 36/67 D |

FOREIGN PATENT DOCUMENTS

| | | | |
|---|---|---|---|
| 563738 | 7/1975 | Switzerland | 36/127 |
| 091004685A | 4/1991 | WIPO . | |
| 091015131A | 10/1991 | WIPO . | |

*Primary Examiner*—Thomas P. Hilliard
*Attorney, Agent, or Firm*—Oldham & Oldham Co.

[57] ABSTRACT

A spike shoe construction including a socket carrying a ribbed insert mounted on and spaced from an outer sole with each socket carrying a reusable lock for locking spikes installed in the socket. Each spike in turn carries a lock which is non-reusable in that it is so distorted or broken when removed to render it inoperative.

6 Claims, 2 Drawing Sheets

FIG.-4
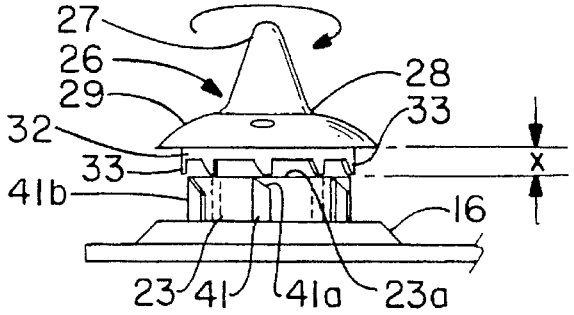
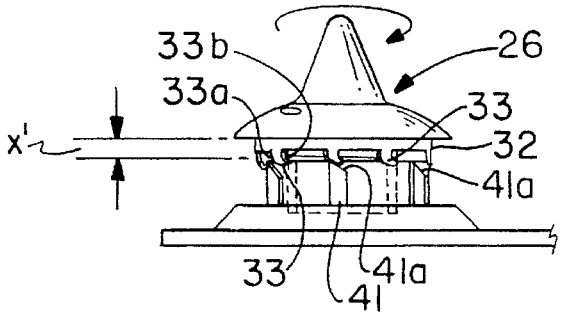
FIG.-5
FIG.-6
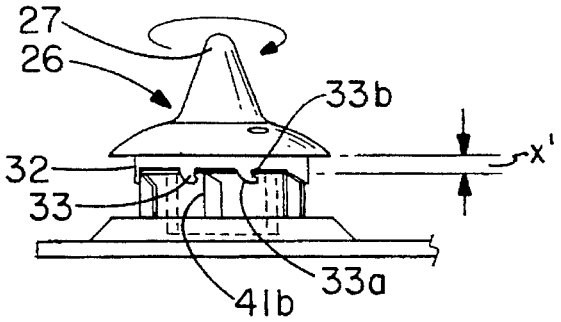
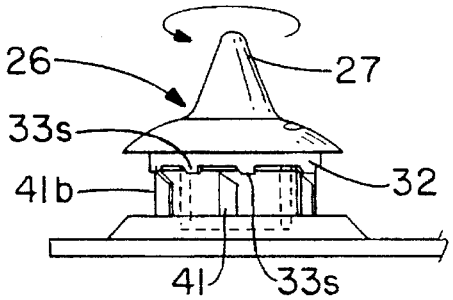
FIG.-7

REMOVABLE SHOE SPIKE LOCKABLE TO CONFIGURED SOLE PLATE

This is a continuation of application(s) Ser. No. 07/124,145 filed on Nov. 23, 1987, now U.S. Pat. No. 5,123,184.

BACKGROUND OF THE INVENTION

Plastic spikes for golf and other spiked shoes have been in use for a number of years (See U.S. Pat. No. 4,587,748). Sole inserts made of plastic for supporting spikes have also been used.

Sole insert and spike systems as structural components in shoe construction, as well as having the capacity of holding plastic spikes in position during service have included a number of drawbacks.

SUMMARY OF THE INVENTION

Briefly, the present invention is a shoe sole construction including a configured lightweight socket bearing insert having reinforcing means around the sockets and strengthening ribs between the sockets. Spikes are installed into the sockets using locking means on both the sockets and the spikes which locking means on the spike are deformable or frangible or both to allow removal of the spike after it has been installed in lock position.

It is a feature of the invention that inserts, spikes and sockets are made of plastic for lightweight, flexibility and deformability.

BRIEF DESCRIPTION OF THE INVENTION

FIG. 4 is an elevational view of a spike in the process of being initially positioned on the socket;

FIG. 5 is an elevational view of the spike having been rotated further with the spike locking tab being deflected by socket ribs;

FIG. 6 is an elevational view of the spike with the locking tabs having passed the socket ribs; and FIG. 7 is an elevational view of the spike having been rotated in the opposite direction for removal with locking tabs sheared.

DESCRIPTION OF THE PREFERRED EMBODIMENT

Figure 1:
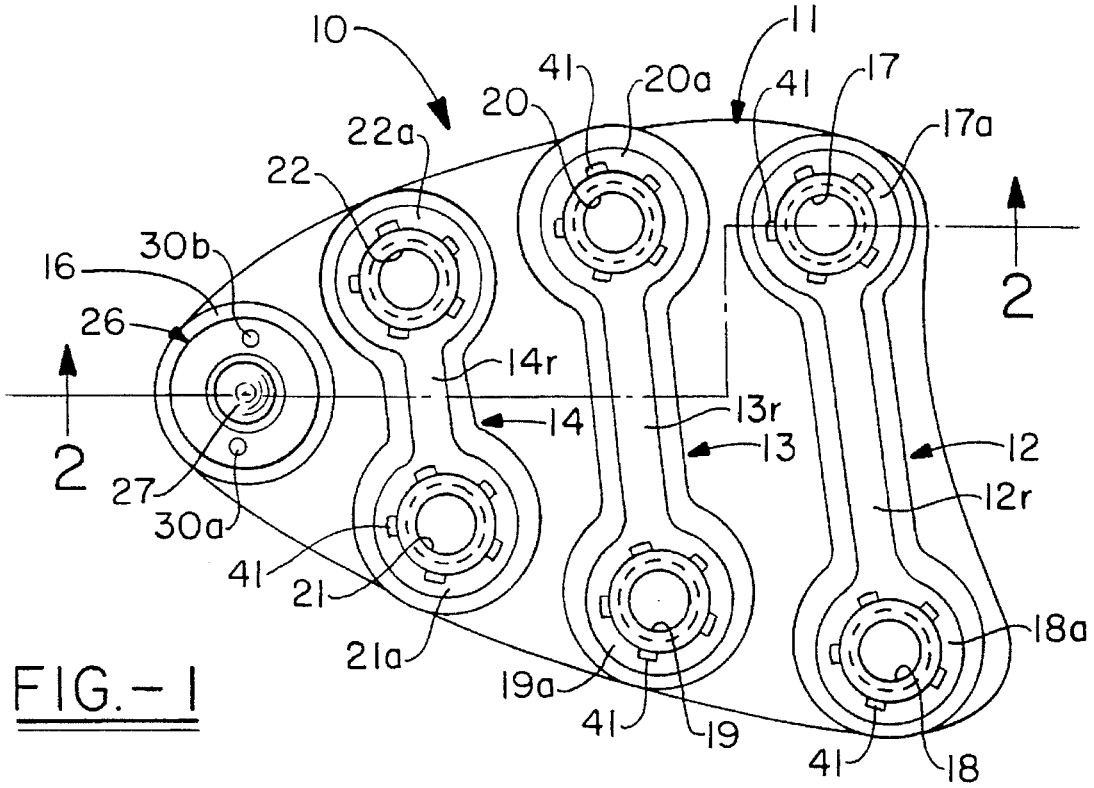
FIG. 1 is a plan view of a sole plate insert having spike-receiving sockets with one spike installed.
Figure 2:
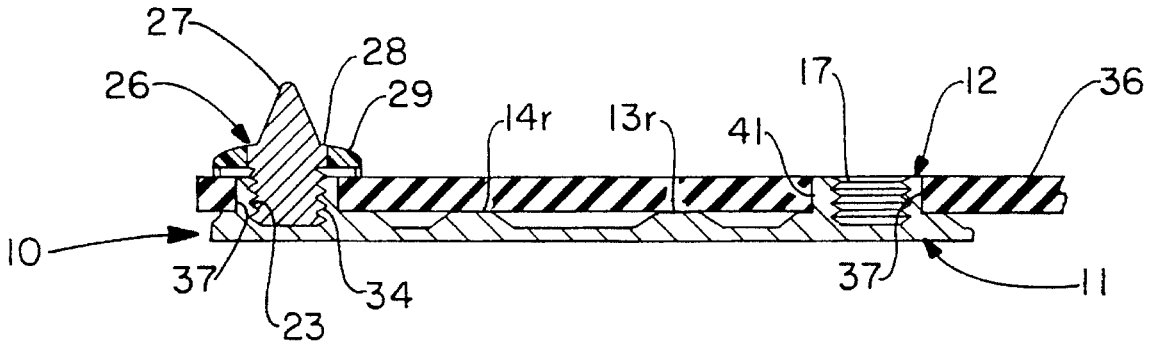
FIG. 2 is a section taken along line 2—2 of FIG. 1 with a portion of the outer shoe sole positioned adjacent the plate insert.
Figure 3:
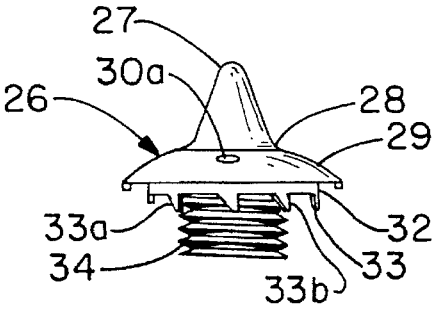
FIG. 3 is an elevational view of a spike.

Referring to FIGS. 1–3, molded plastic shoe insert 10 includes thin body 11, three (3) dumbbell-shaped rib portions 12, 13, and 14, and circular raised portion 16. Formed as part of the rib portions 12, 13, 14 are threaded sockets 17, 18, 19, 20, 21, 22, and 23. Rib portions 12, 13, and 14 have generally circular reinforcing elements 17*a*, 18*a*, 19*a*, 20*a*, 21*a*, and 22*a* positioned around the respective sockets. Rib portions 12, 13, and 14 also include rib crosspieces 12*r*, 13*r*, and 14*r*. Also shown is shoe spike-carrying unit 26 including metal spike pin 27 with metal base 28 and plastic cap 29. Plastic cap 29 has two (2) wrench-receiving holes 30*a*, 30*b* for receiving a tool to screw spike 26 in to install for use and screw it out for removal and replacement.

Turning in particular to FIGS. 1 and 2, the dumbbell rib construction of sole plate 10 permits plate body 11 to be made thinner than a sole without such construction. The present construction provides for a lighter weight and more flexible sole plate. Ribs 12, 13 and 14 also provide spaced-apart support surfaces for a rubber, leather (or other material) outer shoe sole 36 (FIG. 2). The spacing between outer sole socket receiving holes 37 permits relative movement between sole 36 and insert 10. Such relative movement is accomplished with less required forces as compared with a flat non-rib insert plate surface thus providing more flexibility to sole construction.

Turning to FIG. 4, spike 26 is shown in its initial step of being screwed into socket 23. Socket 23 which extends upwardly from circular raised portion 16 includes spaced-apart upstanding socket side projections 41 having slanted upper cam surfaces 41*a* and vertical non-cam surfaces 41*b*. Spike element 26 carries circular skirt 32 with flexible frangible lock tongues 33 depending in spaced manner from skirt 32. The original shape of lock tongue 33 includes cam surface 33*a* and vertical non-cam surface 33*b*. When spike 26 is initially being screwed into socket 23 skirt 32 and the top rim 23*a* of socket 23 are spaced apart. In FIG. 4, as spike 26 is screwed on in the direction of the arrow, lock tongues 33 just clear upstanding side rib 41. In FIG. 5 after spike 26 has been screwed on further and spike skirt 32 is just above the upper rim 23*a* of socket 23, lock tongues 33 are forced to be deformed by camming action of upstanding projection cam surfaces 41*a*. With further turning the lock tongues 33 pass the ribs 41 and restore themselves to some extent to their original shape (FIG. 6). Spike 26 is turned until skirt 32 engages socket upper rim 23*a* or until the spike 26 is otherwise tightly held in place. Each expendable tongue 33 will in this installation process pass against, be deformed by, and pass by a number of socket projections 41 a distance X' from rim 23*a*. The interference between projections 41 and tongues 33 as spike 26 is urged to be turned holds spike 26 in place during shoe use.

When replacement of spike 26 is desired, a wrench is used to turn the spike in the opposite direction (arrow of FIG. 7). Since the tongue vertical side 33*b* is presented to the vertical non-cam side 41*b* of the projection 41, a portion of tongue 33 will shear off leaving tongue stump 33*s* which stump 33*s* can clear the projections 41 and permit removal of the spike 26.

It is also contemplated that the depending tongues may be made of selected materials and so shaped such that the tongues will undergo distortion as the spike is installed and when the spike is removed will undergo additional distortion without shearing or breaking.

I claim:

1. In combination, a socket and stud for an article of footwear, the stud comprising a ground-engaging portion at one end, an externally screw-threaded spigot at its other end and teeth which are spaced outward from the spigot so that an annular gap is formed between the spigot and the teeth, and the socket being an internally screw-threaded unitary moulding of a plastics material comprising a tubular portion having a radially outer surface with complementary teeth on said radially outer surface, said socket and stud arrangement being such that in an assembled condition when the spigot is screwed into the socket, a leading end of the tubular portion is received into said annular gap and the teeth of the stud surround said outer surface of the socket, the teeth of the stud and the teeth of the socket being interengaged to prevent the stud being freely unscrewed.

2. A combination of socket and stud according to claim 5 in which in the assembled condition, at least some of the teeth of the stud are positioned between adjacent ones of the teeth of the socket, being out of contact with the teeth on the socket.

3. A combination of socket and stud according to claim 1 in which the socket constitutes part of a socket unit comprising of similar sockets.

4. A combination of socket and stud according to claim 3 in which the socket unit is in the form of a plate from the underside of which said socket project.

5. A combination of socket and stud according to claim 4 in which thicker areas of the plate form bands, each of which extends across the plate between a pair of associated sockets.

6. An article of footwear provided with a plurality of sockets and studs, each such socket and stud being in accordance with claim 1.

* * * * *